United States Patent [19]

King et al.

[11] Patent Number: 4,766,338

[45] Date of Patent: Aug. 23, 1988

[54] ARC DISCHARGE LAMP

[75] Inventors: Norman R. King; Kent L. Collins, both of Hammondsport, N.Y.

[73] Assignee: North American Philips Corporation, New York, N.Y.

[21] Appl. No.: 39,819

[22] Filed: Apr. 15, 1987

Related U.S. Application Data

[63] Continuation of Ser. No. 684,548, Dec. 21, 1984, abandoned.

[51] Int. Cl.[4] ..... H01J 61/30

[52] U.S. Cl. ..... 313/25; 313/634

[58] Field of Search ..... 313/25, 26, 27, 634

[56] References Cited

U.S. PATENT DOCUMENTS 2,749,461 6/1956 Hierholzer Jr. et al. ..... 313/25
3,706,901 12/1972 De Neve ..... 313/634 X
4,134,042 1/1979 van Heemskerck ..... 315/59
4,277,725 7/1981 Sneijers ..... 315/73

*Primary Examiner*—David K. Moore
*Assistant Examiner*—Sandra L. O'Shea
*Attorney, Agent, or Firm*—Emmanuel J. Lobato

[57] ABSTRACT

A high intensity arc discharge lamp having an elongated outer vitreous envelope sealed by a dome at its upper end and a base assembly at is lower end. An elongated arc discharge tube within the envelope is supported at its lower end by the base assembly and at its upper end by a supporting frame, the lower end of the supporting frame also being supported by the base assembly. To stabilize the upper end of the supporting frame against movement with respect to the outer envelope, a curvilinear flat retaining spring is affixed at one end to the upper end of the supporting frame, the other end of the retaining spring being in free cantilevered compression contact with the dome of the envelope.

3 Claims, 1 Drawing Sheet

ARC DISCHARGE LAMP

This is a continuation of application Ser. No. 684,548, filed Dec. 21, 1984 now abandoned.

BACKGROUND OF THE INVENTION

1. Field of the Invention

This invention relates to high intensity vapor arc lamps of the kind comprising an arc discharge tube contained within an outer vitreous envelope, and more particularly to means for securing the discharge tube in position within the outer envelope.

2. Description of the Related Art

High intensity vapor arc lamps, particularly those employing high-pressure sodium and mercury vapor as the arcing medium, are widely used in highway and other outdoor lighting applications because of their efficient luminosity, generally exceeding 100 lumens per watt. In such lamps the vapor and the thermionic electrodes between which the arc is produced are contained within a sealed light-transmissive alumina ceramic tube, alumina being able to withstand the corrosive action of high temperature sodium. In order to conserve heat, which is necessary for efficient operation, the arc tube is axially supported within an evacuated outer elongated vitreous envelope such as glass. The base of the outer envelope terminates in a narrower neck portion which is sealed by a re-entrant stem capped by a press which supports heavy inlead conductors, the inlead conductors being connected to the shell and center contact of a conventional lamp screw base affixed to the neck portion of the envelope. The arc tube is generally supported by a frame which extends longitudinally within the outer envelope, the support frame itself being supported at its lower end by one of the inlead conductors in the base assembly of the outer envelope. In order to further stabilize the support frame, in most commercial arc discharge lamps the upper end thereof is affixed by a clamp or clip to a projecting dimple which is formed in the central region of the dome at the top of the outer envelope. Such designs are disclosed, for example, in U.S. Pat. Nos. 3,906,272 and 3,384,798. It is also known, in lieu of securing the upper end of the support frame to a dimple at the dome of the outer envelope, to affix a plurality of laterally extending leaf springs at several positions along the length of the frame which bear against the inner sides of the envelope. Such a support frame is disclosed, for example, in U.S. Pat. No. 3,767,965.

It has been generally assumed that for smaller sizes of sodium vapor arc lamps, up to about 150 watts, that the length and bore of the arc discharge tube are sufficiently small and the tube consequently sufficiently light-weight to permit dispensing with support for the upper end of the support frame. This obviates the need for a dimple at the dome of the outer envelope and the clamps or clips for engaging it, as well as for multiple lateral leaf springs, thereby achieving significant cost savings. However, applicants have found that when the upper end of the support frame is left unsupported the lamp is susceptible to breakage when subjected to severe mechanical shock. A typical commercial acceptance shock test involves dropping a standard carton of lamps to a hard surface from a height of two feet; successively on the top, bottom and two adjacent sides of the carton. Failure of the lamps frequently occurs, applicants have found, because movement of the support frame causes the inlead conductor to which it is affixed in the base assembly of the outer glass envelope to break the re-entrant stem which seals the envelope.

SUMMARY OF THE INVENTION

An arc discharge lamp in accordance with the invention is particularly adapted for smaller size lamps, up to about 150 watts. It achieves the simplicity and economy of dispensing with the need for a dimple at the dome of the outer glass envelope and the clamps or clips for securing the upper end of the arc discharge tube support frame to such a dimple, as well as with the need for a plurality of lateral retaining springs for the support frame. The novel structure constituting the invention also achieves far superior impact resistance as compared with designs in which the upper end of the support frame is unsecured, as shown by mechanical shock tests in which standard cartons of lamps embodying the invention survive breakage even when dropped from a height of three feet above a hard surface successively on the top, bottom and two adjacent sides of the carton. As noted above, the standard commercial acceptance shock test involves dropping the carton from a height of only two feet.

Such an arc discharge lamp comprises a support frame within the outer vitreous envelope, the lower end of the support frame being supported by the base assembly at the lower end of the outer envelope and the upper end of the support frame being affixed to and supporting the arc discharge tube which is axially positioned within the outer envelope. A retaining spring of flat curvilinear shape is affixed at one end to the upper end of the support frame, the other end of the retaining spring being in free cantilevered contact with the central dome area of the outer envelope. The curvature of the retaining spring is such that when so positioned the end thereof in contact with the dome is subjected to compression, thereby securing the support frame against movement with respect to the outer envelope when the lamp is subjected to mechanical shock.

BRIEF DESCRIPTION OF THE DRAWINGS

Other features of the invention will be apparent from the ensuing detailed description of a preferred embodiment thereof with reference to the accompanying drawings, in which.

DESCRIPTION OF THE PREFERRED EMBODIMENTS

Figure 1:
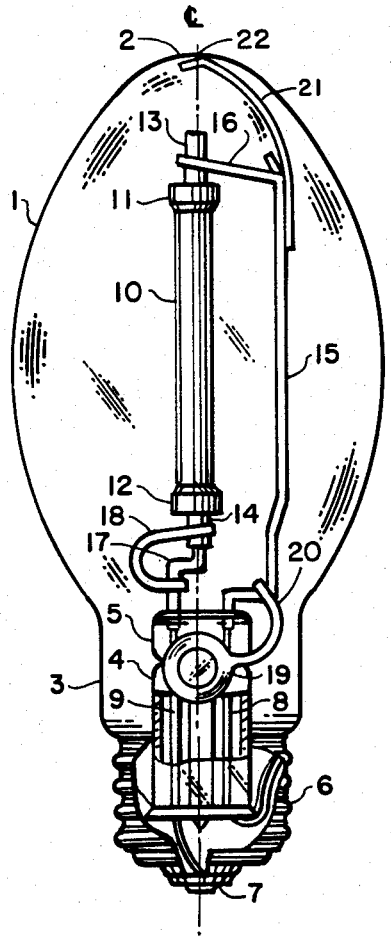
FIG. 1 is a side view of an arc discharge lamp comprising an arc discharge tube supported in accordance with the invention.

The arc discharge lamp in FIG. 1 comprises an elongated axially symmetrical light-transmitting sealed vitreous envelope 1, such as high temperature resistant borosilicate glass. Envelope 1 has a smooth curved dome 2 at its upper end and a base assembly at its lower end comprising a narrow neck portion 3 sealed by a re-entrant stem 4 which is capped by a stem press 5. Affixed to neck portion 3, in conventional manner, is threaded shell 6 and insulated center contact 7 of a standard lamp screw base. The base assembly of envelope 1 also comprises a pair of heavy inlead conductors 8 and 9 respectively connected at their lower ends to shell 6 and contact 7 and which extend through stem 4 and stem press 5. Positioned within envelope 1 along the axis thereof is an elongated high pressure vapor arc discharge tube 10, the ends of which are sealed by end caps 11, 12 which are generally of alumina. Arc discharge tube 10 contains under pressure the arc-producing medium, generally sodium and mercury vapor, and is made of light-transmissive ceramic material such as sintered high density alumina which can withstand corrosive attack by such vapor. A sealed metal tube 13, generally of niobium, is hermetically sealed through upper end cap 11 and serves as an upper inlead conductor for arc discharge tube 10 which is electrically connected within the tube to an upper thermionic electrode contained therein (not shown). A similar sealed metal tube 14 is hermetically sealed through lower end cap 12 and serves as a lower inlead conductor for arc discharge tube 10 which is electrically connected within the tube to the lower thermionic electrode contained therein (not shown).

It should be noted that the designations herein of "upper" and "lower" for various elements or ends of elements of the arc discharge lamp are used solely for purposes of facilitating descriptive identification, and does not mean that the lamp must be mounted vertically as shown in FIG. 1 or in any other particular orientation with respect to its external environment.

In order to support arc discharge tube 10 there is provided within envelope 1 a support frame comprising a rod member 15 extending parallel to the axis of envelope 1 at one side of arc discharge tube 10. The support frame also comprises a bridge member 16, which may be a conductive metal strap, one end of which is secured to the upper end of rod member 15. Bridge member 16 extends laterally from rod member 15 to upper inlead conductor 13 of discharge tube 10, the other end of bridge member 16 being welded to inlead conductor 13. The lower inlead conductor 14 of arc discharge tube 10 and the lower end of side rod 15 are both supported by the base assembly at the lower end of envelope 1. More particularly, lower inlead conductor of arc discharge tube 10 is affixed to one end of a conductive connecting rod 17, the other end of which is welded to inlead conductor 9 of envelope 1 where it extends through stem press 5. The lower end of rod member 15 is bent to align with the other inlead conductor 8 of envelope 1, and is welded thereto where it extends through stem press 5. Further mechanical support for arc discharge tube 10 is provided by a metal strap 18 which is welded at one end to connecting rod 17 and at the other end to inlead conductor 14 of the discharge tube. A barium-containing getter ring 19 is supported by a strap 20 welded to the bend at the lower end of side rod 15.

It will be noted that if no further support were provided for the support frame comprising side rod member 15 and bridge member 16, the support frame and inlead conductor 8 to which it is affixed in the base assembly of envelope 1 would be free to move laterally when the arc discharge lamp is subjected to mechanical shock. As indicated previously, this would tend to cause breakage of stem 4 in the base assembly. In accordance with the invention, this is prevented by providing a curvilinear flat retaining spring 21 which is secured at one end to the upper end of support frame rod member 15, the other end of spring 21 being in free cantilevered contact with the central region of the dome of envelope 1 on the vertical axis of envelope 1. That is, in contrast with prior art designs, there is no mechanical linkage affixing spring 21 to the dome of envelope 1.

Figure 2A:
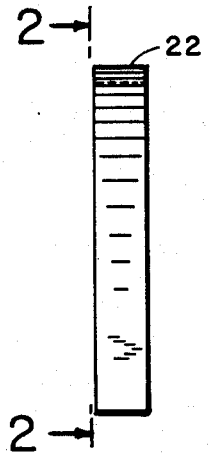
FIG. 2A is a frontal view of the retaining spring in FIG. 2.
Figure 2:
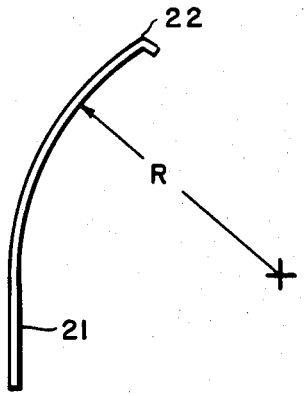
FIG. 2 is a detailed side view of the curvilinear flat retaining spring used in the lamp shown in FIG. 1.

A more detailed side view of retaining spring 21 is shown in FIG. 2, a frontal view thereof being shown in FIG. 2A. It is preferably a rectangular strip of stainless steel having a pre-formed radius of curvature R. A short end portion thereof is preferably angled over so as to provide a linear fulcrum 22 along which the end of the spring contacts dome 2 of envelope 1 as shown in FIG. 1. The curvature of spring 21 is preformed so that when assembled to rod member 15, as described, fulcrum 22 thereof will be deflected downward from its rest position when it contacts dome 2, thereby placing it in compression contact with the dome which serves to resiliently maintain it in position. The stiffness of spring 21 can be increased, if desired, by forming it from two or more flat spring metal strips welded together to form a single compound spring.

The ability of retaining spring 21 to undergo further resilient compression, such as would occur if rod member 15 tended to move laterally with respect to envelope 1, prevents such movement from occurring and therefore minimizes the possibility of internal lamp breakage due to mechanical shock.

What we claim is:

1. An electric lamp comprising:

a transparent elongate outer envelope having a smoothly rounded end portion and a base end portion;

a lamp base attached to said base end portion of said outer envelope;

a light source within said outer envelope;

supporting means for supporting said light source within said outer envelope, said supporting means comprising a rod within said outer envelope extending generally along the length dimension thereof offset from the center line of said outer envelope and having a fixed end at said base end portion of said outer envelope and a free end extending toward said smoothly rounded end portion of said outer envelope, and means for suspending said light source from said rod and for positioning said light source on the center axis of said outer envelope; and a single arcuate leaf spring having a fixed end fixed to said free end of said rod, an arcuate shape extending toward said envelope curved end portion, and curving toward the center line of said outer envelope and a first end bearing against said envelope curved end portion and contacting said envelope curved end portion on the envelope center line, said leaf spring free end having a reverse curvature curving away from the point of contact and defining a fulcrum at which said leaf spring makes contact with said envelope, wherein flexure of said rod causes displacement of the point of contact of said leaf spring and compression of said leaf spring thereby causing said leaf spring to react against the flexure of said rod and center said light source.

2. An electric lamp according to claim 1, wherein said arcuate leaf spring has a preformed radius of curvature in its unflexed condition, and said arcuate leaf spring is in a flexed condition within said lamp outer envelope when said light source is centered within said outer envelope.

3. An electric lamp according to claim 1, wherein said means for suspending said light source from said rod is comprised of a rigid support fixing said light source to said free end of said rod.

* * * * *